United States Patent [19]

Scussel et al.

[11] 4,182,940

[45] Jan. 8, 1980

[54] HIGH VOLTAGE DISTRIBUTOR FOR DUAL IGNITION SYSTEM

[75] Inventors: August J. Scussel, Birmingham; Walter W. Fedison, Jr., Ortonville; Donald R. Michie, Dearborn, all of Mich.

[73] Assignee: Ford Motor Company, Dearborn, Mich.

[21] Appl. No.: 937,694

[22] Filed: Aug. 29, 1978

[51] Int. Cl.[2] ..... H01H 19/00; F02P 7/02

[52] U.S. Cl. ..... 200/19 R; 200/19 DC; 200/19 DR; 123/146.5 A; 123/148 DS

[58] Field of Search ..... 200/19 R, 19 DC, 19 DR, 200/24, 25, 28, 19 WG; 123/146.5 R, 146.5 A, 148 R, 148 DS

[56] References Cited

U.S. PATENT DOCUMENTS

| | | | |
|---|---|---|---|
| 2,756,268 | 7/1956 | Knudson | 123/148 C |
| 3,339,535 | 9/1967 | Mc Clure | 200/19 DC X |
| 3,504,141 | 3/1970 | Webster | 123/146.5 A X |
| 3,646,922 | 3/1972 | Spalding | 123/146.5 A X |
| 3,894,202 | 7/1975 | Campbell et al. | 123/148 R X |
| 3,933,138 | 1/1976 | Stellwagen | 123/146.5 R |
| 4,023,546 | 5/1977 | Kawa Kami | 123/148 DS |
| 4,064,858 | 12/1977 | Forde | 123/148 C X |

*Primary Examiner*—James R. Scott

*Attorney, Agent, or Firm*—Paul K. Godwin, Jr.; Clifford L. Sadler

[57] ABSTRACT

A distributor for use in internal combustion engines requiring sequential application of high voltage to pairs of spark plugs in each cylinder by a separate high voltage supply circuit. The distributor comprising a base portion and a cap portion formed of like insulative material. The base and cap portions of the distributor contain separate sets of switching contacts connected to associated external terminals and separate rotor conductors on a common rotor element. Half the externally mounted terminals in each portion extend in a direction diametrically opposite to the other half so as to eliminate external spark plug wire crossover at the distributor and are electrically connected to the contacts by means of wires internally molded into the insulation of the portions. An installation alignment feature includes a series of apertures in the rotor and the base, whereby a pin inserted therein aligns the rotor conductors to be in accurate registration with a predetermined pair of switching contacts. A unique hexagonal drive shaft provides for an allowable degree of error in mounting the distributor with respect to an axial drive socket on the engine.

11 Claims, 5 Drawing Figures

HIGH VOLTAGE DISTRIBUTOR FOR DUAL IGNITION SYSTEM

BACKGROUND OF THE INVENTION

1. Field of the Invention

The present invention relates to the field of high voltage switching to provide sequential ignition in internal combustion engines. More specifically, the present invention relates to a single distributor which provides high voltage switching to a plurality of spark plugs in each cylinder of an internal combustion engine.

2. Description of the Prior Art

Several patents have issued which describe high voltage distributor constructions for dual ignition systems. Among those, the following are considered to be informative in describing the state of the prior art:

U.S. Pat. No. 2,756,268 describes a distributor for directing electrical impulses simultaneously to pairs of spark plugs, in a predetermined sequence. Input electrodes, from the magneto, are found in the lower case of the distributor in diametrically disposed locations. Inner and outer rings of output electrodes are arranged in the distributor cap and a rotor element, having two separate electrode bars, rotates to provide electrical connection between one input electrode and an output electrode of the inner ring and also to provide simultaneous electrical connection between a second input electrode and an output electrode of the outer ring. It is noted that each of the input electrodes are alternately connected to output electrodes of the inner and outer rings.

U.S. Pat. No. 3,894,202 describes an ignition system for a rotary internal combustion engine, which simultaneously directs ignition spark energy produced by separate ignition coils to leading and trailing spark plugs in the same combustion chamber of the engine. The distributor cap contains two fixed arcuate shaped input electrodes having approximately the same radius of curvature and being disposed about a central axis of the distributor in an oppositely disposed relationship. Output electrodes are disposed in a ring within the distributor cap concentric with the circle formed by the arcuate input electrodes. A rotor element has two diametrically disposed U-shaped electrodes imbedded therein to provide arc-gap connection between the respective input electrodes and the associated output electrodes. It is noted that each of the U-shaped rotary electrodes alternately provide arc-gap connection between the first input electrode and its associated output electrodes and the second input electrode and its associated output electrodes.

U.S. Pat. No. 4,023,546 describes a distributor for an internal combustion engine, wherein at least two high voltage pulses are respectively distributed to at least two spark plugs per cylinder of the engine. The distributor is shown as having a cap member in which all output terminals are mounted. A first high voltage input terminal is centered at the top of the cap and is in frictional contact with a first conducting element of a rotor. The first conducting element of the rotor rotates to define an inner circle. A first set of spark plug electrodes are arranged around the first inner circle for arc-gap connection by the rotating first rotor element. A second input terminal is located at the side of the distributor cap and is in friction contact on a slip ring of a second conducting element on the same rotor. A blade extends from the slip ring and traces a circle displaced from and in a larger diameter than the inner circle. A second set of output electrodes extend from the cap and are arranged so as to be in arc-gap communication with the second conducting element of the rotor.

U.S. Pat. No. 4,064,858 describes an ignition distributor which, in one embodiment, is used with a plurality of ignition coils which discharge simultaneously. The distributor cap includes a conventional center high voltage input terminal which supplies high voltage through a carbon brush to a rotating rotor conducting element. A first set of spark plug electrodes are arranged in an inner circle to be contacted by the rotor conducting element. The rotor has a second connecting element in the form of a ring which is located at the lower perimeter of the rotor. A second high voltage input terminal makes contact with the ring type rotor element through a carbon brush. The ring type rotor element has a tab extending therefrom which contacts with a second set of output electrodes which are evenly arranged around the path of rotation of the tab.

U.S. Pat. No. 3,504,141, although not associated with a dual ignition system, teaches a rotary distributor whereby the spark plug wires are attached thereto in a non-crossover arrangement and are connected to corresponding contacts within the distributor by a printed circuit board element when the cap and the housing are assembled.

U.S. Pat. No. 3,646,922, although not associated with a dual ignition system, teaches a distributor which provides for a set of spark plug contacts to be molded into the distributor cap and a second set of spark plug contacts to be molded into the housing and wherein the wires are connected through the sides of the distributor.

SUMMARY OF THE INVENTION

The distributor of the present invention is intended for front or top mounting on an internal combustion engine wherein the cylinders of the engine are arranged symmetrically on either side of the engine. Furthermore, the engine has a plurality of spark plugs for each cylinder, which must be fired simultaneously in order to maximize combustion. The invention provides for a relatively neat wiring harness without wire crossover at the distributor and a compact unit for simultaneous firing control of spark plug pairs in a firing order as required for proper engine operation.

In the type of engine, for which the invention is presently embodied, a V-8 cylinder configuration is employed. Therefore, since each cylinder contains a plurality of spark plugs, sixteen spark plug wires plus two high voltage supply (coil) wires extend from the distributor. Such a large number of wires would normally present a great potential for cross-firings and misconnections if any of the prior art type distributors were employed. The present invention overcomes that problem and avoids possible wire cutting by the cooling fan or auxiliary drive belts by providing output terminals symmetrically arranged in directions extending from the centerline of the engine and corresponding to the cylinders to which they will be connected by the spark plug wires. It also provides that the high voltage supply terminals extend in the direction in which the ignition high voltage supplies are located. The above provision, of terminals brought out from the distributor to the side corresponding to the side of the engine in which the spark plug connections are made, is achieved by a wiring means integrally molded into the distributor. The wiring means connects internal contacts, arranged in a predetermined firing order, with the output terminals arranged in an order different from the firing order.

The internal switching cavity of the distributor is formed by two circular cup-shaped elements, a base element and a cap element. Each element contains a set of output contacts connected to output terminals and an input contact connected to an input terminal. By using a common rotor body contained electrically isolated rotor conductors, in constant electrical contact with their corresponding input contacts, two separate, but synchronous distributors are formed in one unit.

An installation alignment feature is provided whereby the rotor conductors are each positioned to be correspondingly centered for arc-gap conduction with a predetermined output contact. A pin is inserted into apertures in the base of the distributor and the rotor, in order to lock the relative position of the rotor. After installation on the engine, the pin is removed and discarded.

A unique drive shaft connection between the rotor and the engine provides for a permissible degree of misalignment between the rotational axis of the rotor and the rotational axis of the engine connection, when the distributor is installed thereon. The drive shaft is multisided (e.g., flat sided, serrated, hexagonal, etc.) in cross-section, has one end loosely fitted and pinned into a corresponding retainer at the rotor and has the other end extending outward from the base so as to be loosely fitted into a corresponding multisided drive socket at the engine. The loose fit and multisided cross-section allow for a slight offset between the rotational axis of the engine socket and that of the mounted rotor, while at the same time transferring rotational drive motion through the shaft to the rotor.

Therefore, it is an object of the present invention to provide a high voltage distributor for controlling plural sets of spark plug firings in a predetermined order while providing an internal wiring system that separates associated terminals into groups which extend from the distributor in directions corresponding to spark plug locations.

It is another object of the present invention to provide a high voltage ignition distributor with an installation alignment mechanism whereby the distributor rotor conductors are held precisely located with respect to a predetermined corresponding output contact.

It is a further object of the present invention to provide a high voltage ignition distributor with a unique drive shaft assembly which, when installed on an engine, allows rotational drive motion to be transferred from the engine to the rotor and permits a degree of misalignment to exist between the relative axes of rotation.

BRIEF DESCRIPTION OF THE DRAWINGS

FIG. 4 is an elevational cross-section of the present invention taken through IV—IV of FIG. 3; and .

DESCRIPTION OF THE PREFERRED EMBODIMENT

Figure 1:
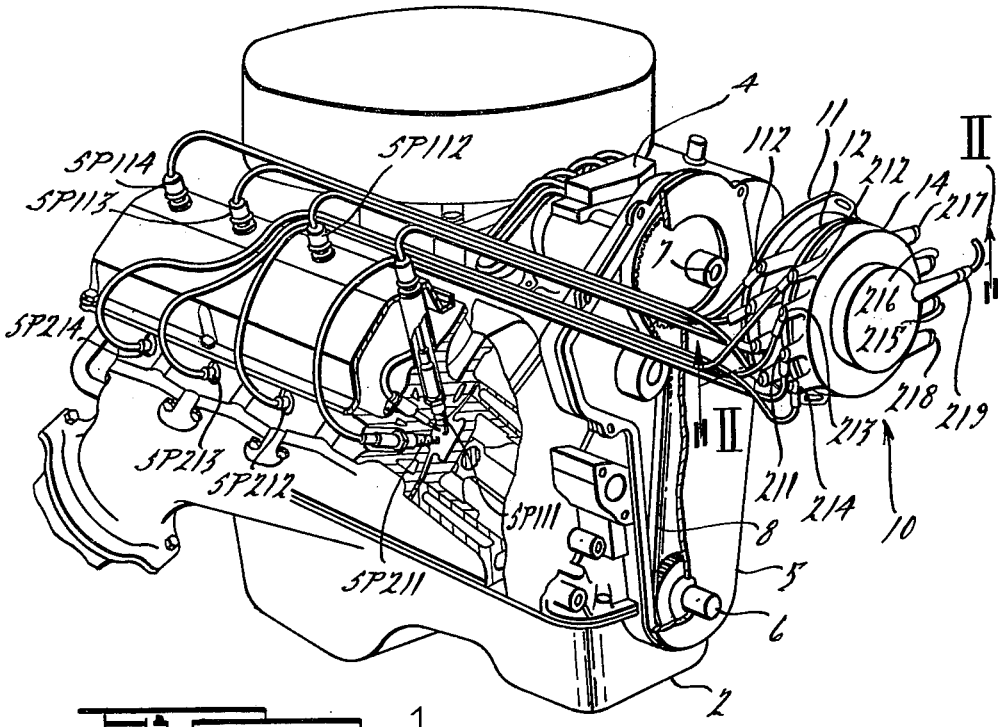
FIG. 1 illustrates the distributor of the present invention in an exploded view with respect to a preferred engine mounting.
Figure 5:
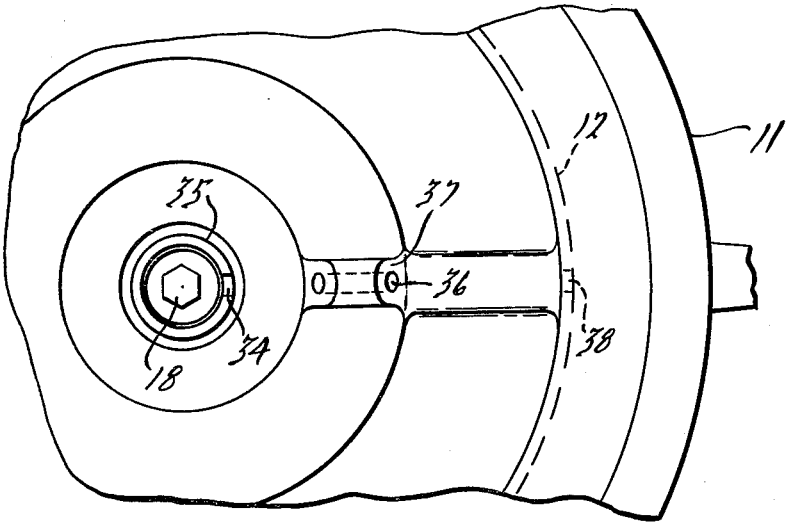
FIG. 5 is a partial bottom view of the present invention illustrating the installation alignment means.

The present invention is a distributor 10, shown in FIG. 1 as being mounted on the front end of a V-8 type engine 2 which utilizes a fuel injection pump 4 and a pair of spark plugs, for ignition of the injected air fuel mixture, in each cylinder. A tensioned timing belt 8 provides connection between the crankshaft 6 of the engine 2 and the fuel injection pump 4 behind a cover plate 5. In this particular example, a sprocket 7, having a hexagonal shaped socket is used for communicating rotational drive to a corresponding multisided drive shaft 18 of the distributor 10. Items not shown that are generally driven by the engine may include an alternator, a power steering pump, an air conditioning compressor, and a radiator cooling fan and are also normally mounted on the front of the engine 2. Although those items are not shown, it should be noted that the distributor 10 is designed to provide a space efficient arrangement of the high voltage wires from the distributor to the individual spark plugs in a manner which eliminates the chances of being caught in the auxiliary items or their drive belts. The design also eliminates possible engine misfire due to spark plug wire crossover.

Figure 2:
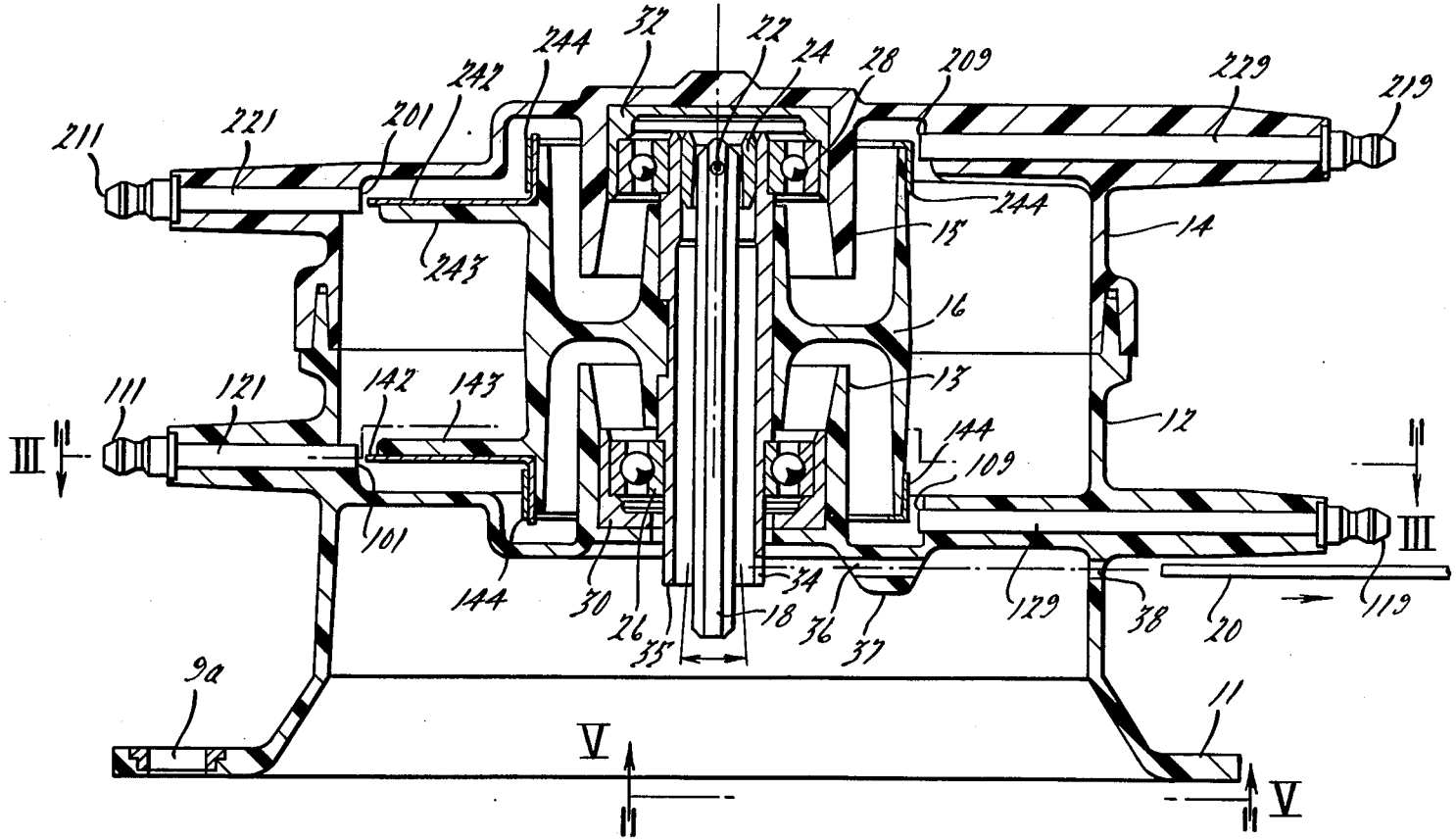
FIG. 2 is an elevation cross-section of the present invention taken through II—II of FIG. 1.
Figure 3:
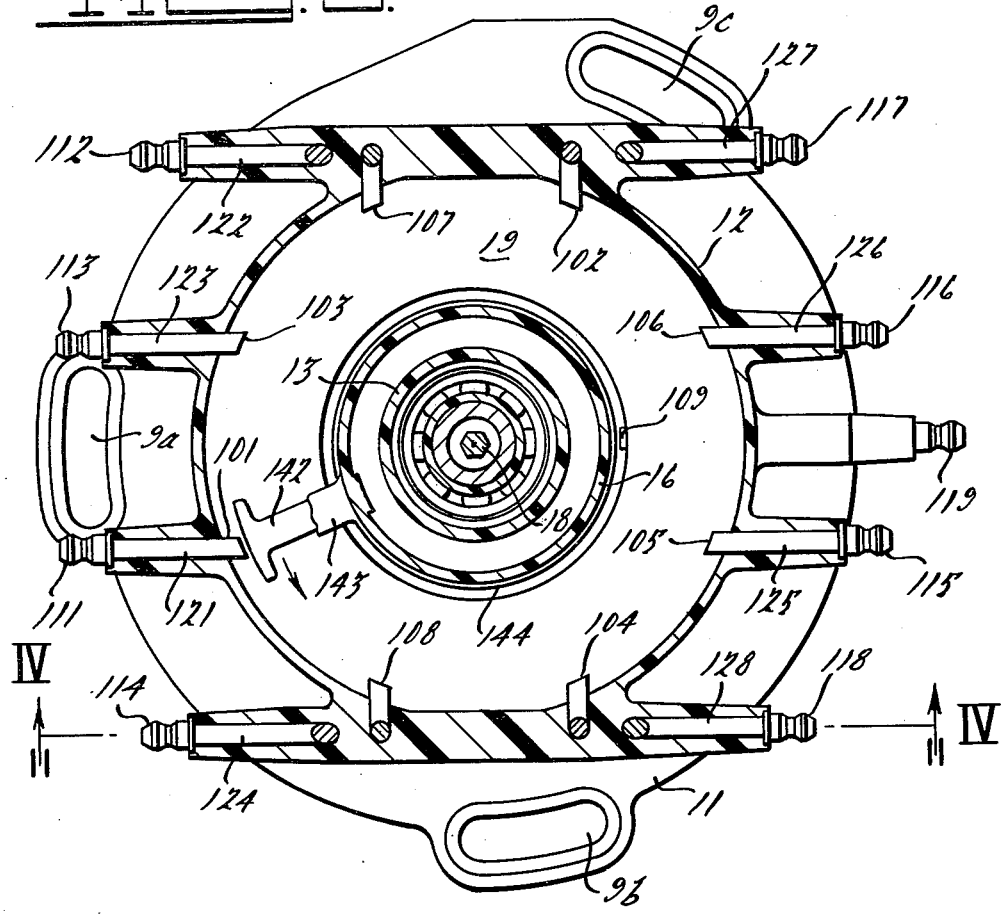
FIG. 3 is a top cross-section view of the distributor of the present invention taken through III—III of FIG. 2.
Figure 4:
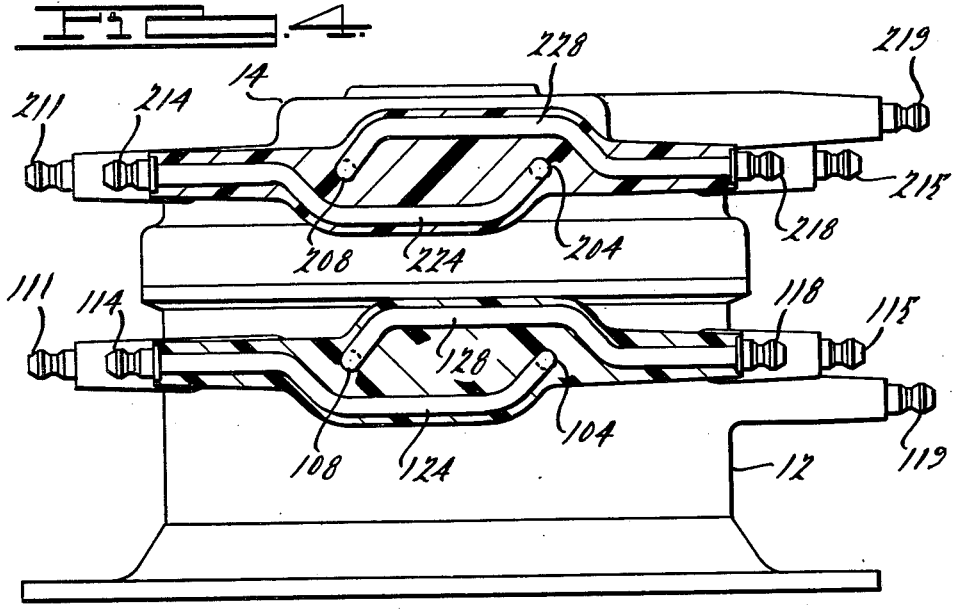

The distributor 10 is hereinafter concurrently referred to in FIGS. 2–4 and comprises a base element 12, a cap element 14 and a rotor element 16. The base 12 contains a mounting flange 11 which has mounting slots **9*a*, 9*b*, and 9*c* for mounting on the cover plate 5. The distributor base 12 also includes a circular internal cavity 19 having a plurality of output switching contacts 101, 108, 104, 105, 106, 102, 107, and 103 lying in a plane on the circular periphery thereof. The output switching contacts are correspondingly connected with output terminals 111, 118, 114, 115, 116, 112, 117, and 113 by large cross-sectional wires 121, 128, 124, 125, 126, 122, 127 and 123** which are molded as an integral part of the insulative base.

Since the distributor is intended for use in a crowded engine compartment, it is most important that the wires which extend from the terminals to the respective spark plugs be routed from the distributor in a direction towards the corresponding spark plugs. In the case of the illustrated V-8 engine, the cylinders #1, #2, #3, and #4 are designated as being on the right side of the engine in sequence from front to back of the engine and cylinders #5, #6, #7, and #8 as being on the left side of the engine in sequence from front to back. However, due to the fact that the specified firing order of the cylinders is 1-8-4-5-6-2-7-3, it is apparent that this firing order dictates that the output switching contacts be arranged in a particular sequence within the cavity of the distributor base 12 and that this sequence is different from the physical arrangement of the cylinders of the engine. Therefore, the present invention includes means integral with the distributor which provides for internal crossover connections between the appropriate terminals and their associated output contacts so as to provide a symmetric arrangement of the output terminals corresponding to the arrangement of the cylinders in the engine. Specifically, referring to FIGS. 3 and 4, terminals 111, 112, 113, and 114 extend from one side of the distributor base and terminals 115, 116, 117, and 118 extend from the opposite side of the distributor base. These terminals are correspondingly connected to spark plugs SP111 of cylinder #1, SP112 of cylinder #2, SP113 of cylinder #3, SP114 of cylinder #4, et seq.

The connecting means which provides for the arrangement of the terminals corresponding to the physical location of the spark plugs on the engine includes the heavy wire 124 between terminal 114 and its associated output contact 104. The wire 124 is physically routed around contact 108 and its associated wire 128, which is also part of the connecting means. The heavy wires 124 and 128 are insulated from each other by the insulative material of the distributor base 12. Likewise, the wires 122 and 127, respectively, associated with terminals 112 and 117 are routed around each other so as to be connected to the corresponding contacts 102 and 107. This internal crossover connection within the distributor 12 eliminates any spark plug wires crossing over the distributor thereby providing for a neater wiring harness and eliminating potential cross firings between wires and potential cutting by belts or the cooling fan located at the front of the engine. The connecting means further includes high voltage input terminal 119 being connected to input contact 109 by a heavy wire 129. However, the input terminal 119 is in continuous arc-gap contact with a rotor to be described later, and its physical location about the perimeter of the distributor base 12 will henceforth be dictated by the relative location of the high voltage supply.

A distributor cap 14 is formed to fit on the distributor base 12 and is substantially a mirror image of the base 12, in that it contains a plurality of output contacts joined by connecting means to associated output terminals arranged as described with respect to the base and also extending outward from the sides thereof. The cap also has an input terminal 219 which supplies high voltage through a heavy wire 229 to an input contact 209.

The distributor base 12 and distributor cap 14 respectively contain molded cups 13 and 15 which respectively hold bearing retainers 30 and 32; as well as provide dielectric insulation between the normally grounded bearing retainers and the rotor conducting rings 144 and 244, which are discussed below. A rotor having a main insulative body 16 is supported for rotation with respect to said distributor base 12 and distributor cap 14 via ball bearings 26 and 28 which are held in bearing retainers 30 and 32, respectively. The rotor main body 16 supports a first circular conducting ring 144 which is in continuous arc-gap communication with input contact 109. The rotor also contains a radial support member 143 to support a conducting rotor blade 142 electrically connected to the first ring 144. The rotor blade 142 is arcuate shaped and provides for arc-gap communication with the individual output contacts lying in its plane of rotation during its rotation within the cavity 19. The arcuate shape of the blade 142 provides for a time period of arc-gap registration between each output contact in order to allow for advance or retard of the spark by an electronic engine control.

The opposite end of the main rotor body 16 supports a second conducting ring 244 which is in continuous arc-gap communication with the second high voltage input contact 209. A second conducting rotor blade 242 is supported by a radial support member 243 extending from the rotor 16 and is electrically connected to the second ring 244. The second rotor blade 242 extends in exactly the same direction as blade 142 but is offset along the rotational axis of the rotor to provide electrical insulation therebetween. The second rotor blade 242 provides arc-gap registration with the second set of output contacts 201, 208, 204, 205, 206, 202, 207, and 203 (note the order for sequential switching is the same in the first set of contacts as it is for the second set). The output contacts are respectively connected to cap terminals 211, 218, 214, 215, 216, 212, 217 and 213. Those terminals are respectively connected to a spark plug wire and thereby to the second spark plug associated with each cylinder. Similar to the base 12, the distributor cap 14 has terminals 211, 212, 213 and 214, which extend from one side of the distributor and terminals 215, 216, 217 and 218, which extend from the opposite side of the distributor. They are correspondingly connected to spark plugs SP211 of cylinder #1, SP212 of cylinder #2, SP213 of cylinder #3, SP214 of cylinder #4 et seq.

In operation, the input terminal 119 is connected to a first high voltage ignition source and the input terminal 219 is connected to a second high voltage ignition source. The high voltage sources are controlled for proper duration ignition pulses which are simultaneously fed through the distributor to pairs of spark plugs in the appropriate cylinders. The high voltage sources and controlled circuitry are not shown since they are only incidental to the operation of the present invention and are not deemed to be a part thereof.

The main body of the rotor 16 and bearings 26 and 28 are mounted on a central sleeve 35 which extends from inside the bearing retainer 32 through the bottom of the cavity of the distributor base 12. A coupling retainer 24 is press fitted into the upper end of the sleeve 35 and is provided with a hexagonal aperture extending along its axis. A hexagonal drive shaft 22 has a smaller cross-sectional dimension than the hexagonal opening of the coupling retainer 24. A pin 22 extending across the aperture of retainer 24 retains the drive shaft 18 within the retainer 24 and prevents it from falling out of position prior to installation on the engine. The large opening of the retainer 24 allows for the shaft 18 to be slightly canted with respect to the rotational axis of the rotor and still provide the necessary drive torque. The lower end of the drive shaft 18 extending through the bottom of the cavity of the base 12 is fitted into the sprocket 7 extending from the fuel injection pump 4.

The aforementioned drive shaft assembly, of course, allows a flexibility in the installation of the distributor so that axial drive motion will be communicated to the rotor without requiring that the drive shaft be exactly centered. Furthermore, if the drive shaft were a tight fitting connection, vibrations or unevenness in the cover plate 5 on which the distributor is installed, may possibly cause binding of the shaft.

In the engine shown, it is required that synchronization be maintained between the crankshaft, the injection pump, and the distributor. Therefore, to assist in accurate installation, the present invention provides a device for maintaining the rotor blade in the center of the No. 1 firing position, i.e., rotor blade 142 at the center of the No. 1 firing position, i.e., the center of rotor blade 142 in registration with output contact 201. This alignment is achieved by use of a pin 20 made of a malleable material such as soft aluminum or plastic which is inserted in an aperture 38 in the side of the base 12, an aperture 36 in an alignment guide 37 molded on the bottom of the base 12 and an aperture 4 in the sleeve 5. By inserting pin 20, the rotor element is prevented from rotating and alignment of the rotor blade with the No. 1 firing position is maintained. After the distributor is mounted on the engine, the pin is withdrawn and discarded. However, in the event that the installer neglects to remove the pin 20, the softness of the material forming that pin will not prevent operation or cause damage to the distributor if the engine is started. In that event, the pin 20 will be severed at the sleeve 35.

It will be apparent that many modifications and variations may be effected without departing from the scope of the novel concept of this invention. Therefore, it is intended by the appended claims to cover all such modifications and variations which fall within the true spirit and scope of the invention.

We claim:

1. A high voltage distributor for providing simultaneous switching for a dual ignition system comprising:

a base member having a circular internal cavity about a central axis;

a plurality of first conductive contacts equally spaced in a first plane about the periphery of said internal cavity of said base member;

a plurality of first output terminals located on said base member outside said cavity respectively corresponding to said first contacts;

a first common contact located inwardly of the periphery of said cavity of said base member;

a first common input terminal located on said base member outside said cavity;

first means integral with said base member for respectively electrically connecting said first contacts and said first common contact to said corresponding first terminals and said first common terminal;

a cap member, adapted for mating with said base member, having a circular internal cavity corresponding to said base member cavity, whereby a closed cylinder is defined by the mating of said cap member with said base member;

a plurality of second conductive contacts equally spaced in a second plane about the periphery of said internal cavity of said cap member;

a plurality of second output terminals located on said cap member outside said cavity respectively corresponding to said second contacts;

a second common contact located inwardly of the periphery of said cavity of said cap member;

a second common input terminal located on said cap member outside said cavity;

second means integral with said cap member for respectively electrically connecting said second contacts and said second common contact to said corresponding second terminals and said second common terminal; and rotor means located within said defined cylinder for providing sequential electrical connection between said first common contact and each of said plurality of first contacts and for simultaneously providing sequential electrical connection between said second common contact and each of said plurality of second contacts.

2. A distributor as in claim 1, wherein said first means includes conducting wires having the same conductive capacity as said contacts for connecting said contacts to corresponding terminals.

3. A distributor as in claim 1, wherein said rotor means includes:

an insulating support member having a circular cross-section main body;

a first conducting ring mounted on said main body for continuous arc-gap communication with said first common contact;

a first conducting blade member electrically connected to said first ring and extending outwardly therefrom over a predetermined angle within the circular location of said first conducting contacts to provide sequential arc-gap communication with said first conducting contacts as it rotates in said first plane;

a second conducting ring mounted on said main body spaced from said first conducting ring along said central axis, for continuous arc-gap communication with said second common contact; and a second conducting blade member electrically connected to said second ring and extending outwardly therefrom over a predetermined angle within the circular location of said second conducting contact to provide sequential arc-gap communication with said second conducting contacts as it rotates in said second plane.

4. A distributor as in claim 3, wherein said first terminals define first and second sets which extend oppositely outward from said base;

said first means provides internal crossover connection within said base member between said first terminals of the first and second sets and their corresponding first conductive contacts; and further wherein said second terminals define third and fourth sets which extend oppositely outward from said cap member; and said second means provides internal crossover connection within said cap member between second terminals of said third and fourth sets and their corresponding second conductive contacts.

5. A distributor as in claim 3 for use on an internal combustion engine wherein said distributor includes means for aligning said first and second rotor blade members with preselected contacts during installation of said distributor on said internal combustion engine.

6. A distributor as in claim 5, wherein said rotor means includes a central shaft extending outside said base member for receiving a rotational drive connection from said engine and a sleeve surrounding a portion of said shaft;

said alignment means includes an aperture in said sleeve outside said base member having a predetermined fixed angular relationship between the first and second conducting blade members referenced along said central axis; a radial aperture and radial guide on said base member; and a removable pin member within said apertures and radial guide to hold said rotor means in a relatively fixed position with respect to said base member during said installation.

7. A distributor as in claim 6, wherein said rotor includes:

a circular sleeve fixedly secured to said main body and extending along said central axis from said cap member through said base member;

a multisided cross-section drive shaft within said circular sleeve member; and means at the cap end of said sleeve for transferring rotational forces from said multisided drive shaft to said sleeve and retaining said drive shaft within said sleeve.

8. A distributor as in claim 7, wherein said transfer means is a retainer element having an outer diameter approximately the same as the internal diameter of said sleeve to provide a compression fit therebetween and an internal multisided opening slightly larger than said driveshaft.

9. A high voltage distributor for use on an internal combustion engine requiring the firing of two spark plugs per cylinder comprising:

an insulative base member adapted to be mounted on said engine and having an internal cylindrical switching cavity;

a first set of stationary contacts evenly distributed in a first plane about the periphery of said base switching cavity of said base;

a first common stationary contact located inwardly of said first set of contacts in said base switching cavity in a second plane separate from said first plane;

a rotor element including a main insulative body portion, a first common electrically conductive ring element lying in said second plane for continuous arc-gap communication with said first common contact and a first arcuate blade element lying in said first plane connected to said first common ring element for individually selecting said first contacts for arc-gap communication;

an insulative cap member adapted to be mounted on said base member and having an internal cylindrical switching cavity similar to that of said base member;

a second set of stationary contacts evenly distributed in a third plane above the periphery of said cap switching cavity of said cap member;

a second common stationary contact located inwardly of said second set of contacts in said cap switching cavity in a fourth plane separate from said third plane;

said rotor element including a second common electrically conductive ring element lying in said fourth plane for continuous arc-gap communication with said second common contact and a second arcuate blade element lying in said third plane connected to said second common ring element for individually selecting said second contacts for arc-gap communication.

10. A distributor as in claim 9, wherein said first set of contacts are arranged about said base switching cavity so as to be contacted by said first arcuate rotor blade in an order which corresponds to the firing order of the cylinders in said engine and said distributor further includes externally mounted terminals respectively electrically connected to corresponding ones of said first set of contacts by first means integral with said base member to provide a separation of said terminals on said distributor base member in accordance with the physical location of the associated cylinders on said engine.

11. A distributor as in claim 10, wherein said second set of contacts are arranged about said cap member switching cavity so as to be contacted by said second arcuate rotor blade in an order which corresponds to said firing order and said distributor further includes externally mounted terminals respectively electrically connected to corresponding ones of said second set of contacts by second means integral with said cap member to provide a separation of said terminals on said distributor cap member in accordance with the physical location of the associated cylinders on said engine.

* * * * *